US008923743B2

(12) United States Patent
Suda

(10) Patent No.: US 8,923,743 B2
(45) Date of Patent: Dec. 30, 2014

(54) IMAGE FORMING APPARATUS THAT APPLIES NECESSARY AMOUNT OF LUBRICANT TO IMAGE BEARING MEMBER

(75) Inventor: Takeyuki Suda, Toride (JP)

(73) Assignee: Canon Kabushiki Kaisha (JP)

( * ) Notice: Subject to any disclaimer, the term of this patent is extended or adjusted under 35 U.S.C. 154(b) by 138 days.

(21) Appl. No.: 13/545,151

(22) Filed: Jul. 10, 2012

(65) Prior Publication Data

US 2013/0017006 A1 Jan. 17, 2013

(30) Foreign Application Priority Data

Jul. 13, 2011 (JP) ..... 2011-154795

(51) Int. Cl.
*G03G 21/00* (2006.01)
*G03G 15/00* (2006.01)

(52) U.S. Cl.
CPC .... *G03G 15/5008* (2013.01); *G03G 2215/0129* (2013.01); *G03G 21/0005* (2013.01); *G03G 21/0094* (2013.01)
USPC ..... 399/346; 399/265; 399/343; 399/353; 184/17; 184/99

(58) Field of Classification Search
CPC ..... G03G 15/5008; G03G 15/0005; G03G 21/0094; G03G 2215/0129
USPC ..... 399/66, 343, 346, 352, 34, 36, 71, 132, 399/265, 297, 302; 184/14, 17, 99
See application file for complete search history.

(56) References Cited

U.S. PATENT DOCUMENTS

| | | | | |
|---|---|---|---|---|
| 6,775,511 | B2 * | 8/2004 | Kosuge | 399/346 |
| 7,209,699 | B2 * | 4/2007 | Yamaguchi et al. | 399/346 |
| 2008/0069614 | A1 * | 3/2008 | Shintani et al. | 399/346 |
| 2009/0324310 | A1 * | 12/2009 | Matsumoto et al. | 399/346 |
| 2011/0064433 | A1 * | 3/2011 | Asaoka et al. | 399/46 |

FOREIGN PATENT DOCUMENTS

| | | | |
|---|---|---|---|
| JP | 2009294248 | A * | 12/2009 |
| JP | 2010-096988 | A | 4/2010 |

* cited by examiner

*Primary Examiner* — Francis Gray
(74) *Attorney, Agent, or Firm* — Rossi, Kimms & McDowell LLP

(57) ABSTRACT

An image forming apparatus configured to apply a necessary amount of a lubricant to an image bearing member while preventing the lubricant from being excessively consumed. An intermediate transfer belt drive motor controlled by a PID controller drives an intermediate transfer belt. A brush rotation controller for controlling an application brush drive motor detects fluctuation in a frictional force between a cleaning blade and the intermediate transfer belt, and controls the application brush drive motor such that an amount of lubricant to be applied is an amount corresponding to the detected fluctuation in the frictional force.

10 Claims, 10 Drawing Sheets

【DURING NORMAL OPERATION】

【WHEN LUBRICANT IS INSUFFICIENT】

IMAGE FORMING APPARATUS THAT APPLIES NECESSARY AMOUNT OF LUBRICANT TO IMAGE BEARING MEMBER

BACKGROUND OF THE INVENTION

1. Field of the Invention

The present invention relates to an image forming apparatus equipped with a lubricant application mechanism for applying a lubricant onto an image bearing member, such as a photosensitive drum or an intermediate transfer belt.

2. Description of the Related Art

Conventionally, an electrophotographic image forming apparatus, such as a copying machine or a printer, performs a process for image formation, including forming a toner image on an image bearing member, such as a photosensitive drum and an intermediate transfer belt, transferring the generated toner image on the image bearing member onto a sheet, and then fixing the toner image on the sheet to complete the image formation.

In such an image forming apparatus, not all toner of the toner image formed on the image bearing member, such as the intermediate transfer belt, is transferred onto a sheet, but a slight amount of toner which has not been transferred remains on the intermediate transfer belt. To positively remove foreign matters, including the above-mentioned remaining toner and paper powder which is attached from the sheet to the intermediate transfer belt during transfer of the image onto the sheet, the image forming apparatus is provided with a cleaning device for cleaning the intermediate transfer belt.

The cleaning device is configured to be brought into sliding contact with the intermediate transfer belt so as to eliminate powder remaining on the intermediate transfer belt, and hence there arises a problem of a frictional force acting between the cleaning device and the intermediate transfer belt. Further, when the cleaning device or the intermediate transfer belt deteriorates, the frictional force acting between the both increases to accelerate deterioration of the cleaning device and the intermediate transfer belt, whereby the frictional force further increases.

If the frictional force acting between the cleaning device and the intermediate transfer belt thus increases, abnormal noises may be generated from contact portions of the cleaning device and the intermediate transfer belt where the two are brought into contact with each other, and further, foreign matters may pass between the contact portions, which sometimes causes a cleaning failure.

To reduce the frictional force between the cleaning device and the intermediate transfer belt, the image forming apparatus is provided with a mechanism that applies a lubricant to the image bearing member, such as an intermediate transfer belt, and continuously performs lubricant application to thereby achieve reduction of the frictional force.

However, if the lubricant is excessively applied, the excessive amount of the lubricant cannot be scraped by the cleaning device, and as a result, part of the lubricant is conveyed up to a member, such as an electrostatic charger, and soils the member, which sometimes causes an image failure. To prevent such a problem, it is necessary to control the lubricant to a proper amount so as to prevent the lubricant from passing beyond the cleaning device, and soiling associated members, while reducing the frictional force.

That is, the image forming apparatus is required not only to apply a proper amount of the lubricant to the intermediate transfer belt, but also to prevent the lubricant from being excessively consumed, and an image failure from occurring, which is caused by adhesion of the excessive lubricant to the electrostatic charger.

A conventional image forming apparatus is configured such that a rotating lubricant application brush performs scraping of solid lubricant and application of the same to an image bearing member. Further, there has been proposed a technique in which the rotational speed of a lubricant application brush is properly changed according to the rotational speed of an image bearing member to thereby control the amount of applied lubricant to a proper amount (see e.g. Japanese Patent Laid-Open Publication No. 2010-096988).

When controlling the rotational speed of the lubricant application brush according to the traveling speed of the image bearing member as mentioned above, the lubricant is applied in an amount responsive to a change in the traveling speed of the image bearing member.

However, when the lubricant is applied in an amount responsive to a change in the traveling speed, it is not configured such that an actual excess or insufficiency of the lubricant is detected, and the lubricant is supplied according to the actual excess or insufficiency of the lubricant. Therefore, there sometimes occurs a case where an amount of the lubricant required according to the actual state of friction is not properly supplied between the cleaning device and the intermediate transfer belt.

SUMMARY OF THE INVENTION

The present invention provides an image forming apparatus which is configured to apply a necessary amount of a lubricant to an image bearing member while preventing the lubricant from being excessively consumed, and is capable of suppressing abnormal noises from being generated between the image bearing member and a cleaning blade, toner from passing therebetween, and the cleaning blade, the image bearing member, and the like from being deteriorated.

The present invention provides an image forming apparatus comprising an image bearing member configured to bear a toner image, a first drive unit configured to drive the image bearing member, a first control unit configured to control the first drive unit, a cleaning unit configured to clean a surface of the image bearing member, a lubricant application unit configured to apply a lubricant to the surface of the image bearing member, a second drive unit configured to drive the lubricant application unit, and a second control unit configured to control the second drive unit, wherein the second control unit detects fluctuation in a frictional force between the cleaning unit and the image bearing member, and controls the second drive unit such that an amount of lubricant to be applied becomes an amount corresponding to the detected fluctuation in the frictional force.

According to the present invention, it is possible to apply a necessary amount of the lubricant between the cleaning blade and the image bearing member, while preventing the lubricant from being excessively consumed. This makes it possible to provide an image forming apparatus capable of preventing abnormal noises from being generated between the image bearing member and the cleaning blade, toner from passing therebetween, and the cleaning blade, the image bearing member, and the like from being deteriorated.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 2:
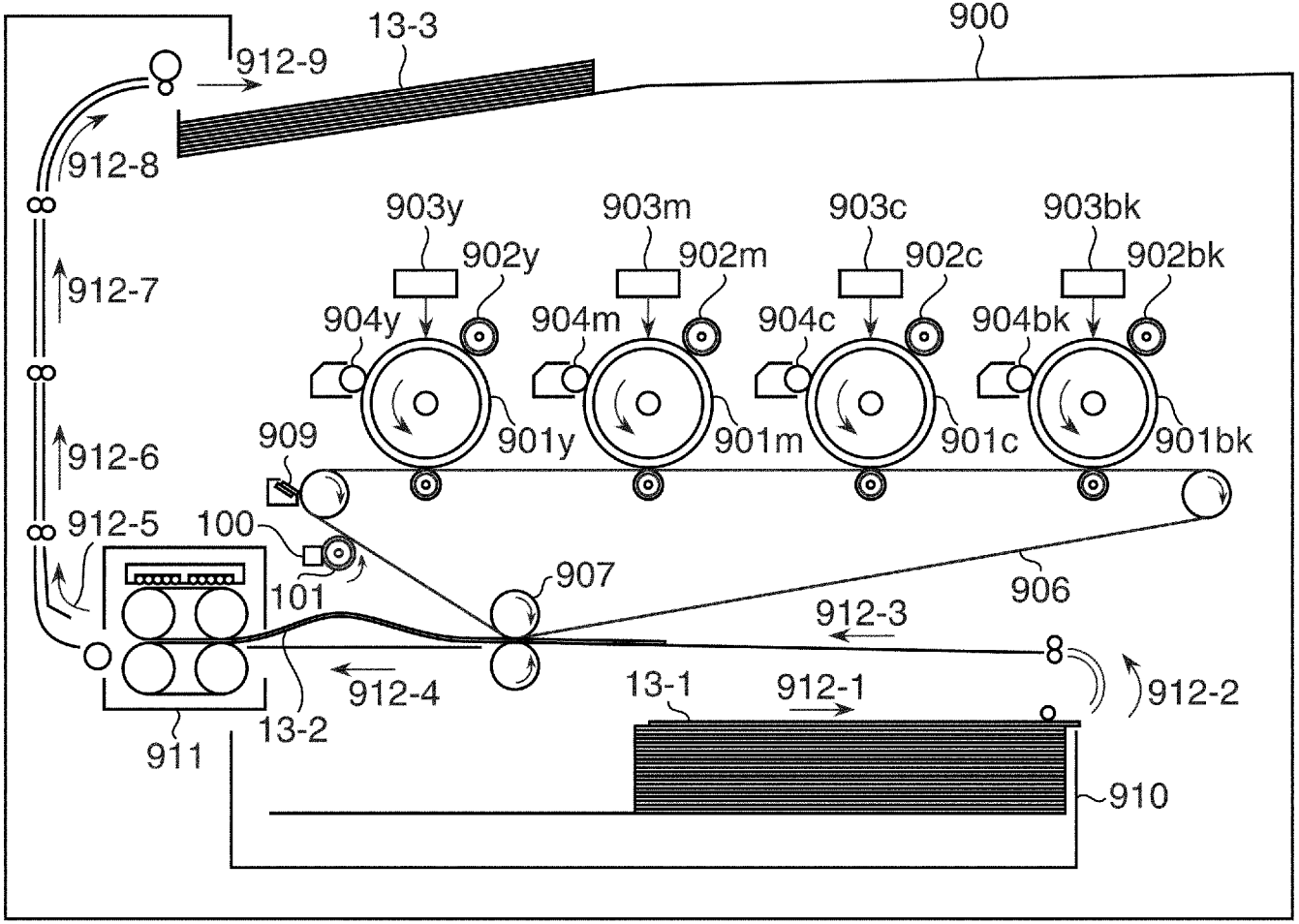
FIG. 2 is a schematic view useful in explaining the configuration of the electrophotographic color printer as the image forming apparatus according to the first embodiment.

FIG. 2 is a schematic view of the entire configuration of an electrophotographic color printer as an image forming apparatus according to a first embodiment of the present invention, and reference numeral 900 denotes a color printer main unit. The color printer main unit 900 includes developing devices associated with respective four colors of Y (yellow), M (magenta), C (cyan) and K (black), an intermediate transfer belt 906, a sheet feeder 910, secondary transfer rollers 907, and a fixing device 911 arranged therein. In the color printer main unit 900 configured as above, toner images of the respective colors are formed by the developing devices associated with the respective four colors of Y, M, C, and K. The toner images of the respective colors formed as above are sequentially transferred onto the intermediate transfer belt 906 in superimposed relation, and are conveyed to the secondary transfer rollers 907 by a rotating operation of the intermediate transfer belt 906.

With this operation, a sheet 13 having been drawn out of the sheet feeder 910 is conveyed to the secondary transfer rollers 907. Then, the sheet 13 is sandwiched by and is brought into pressure contact with a pair of the secondary transfer rollers 907, in a state in which a leading position of the color toner image on the intermediate transfer belt 906 is aligned with a predetermined leading position on the sheet 13 and is overlaid with each other, whereby the color toner image is transferred onto the sheet 13. The sheet 13 having the color toner image transferred thereon is conveyed to the fixing device 911, and the unfixed toner image is fixed on the sheet 13 by heat pressure contact, whereby the image formation processing is completed. The sheet 13 having the image thus formed thereon is conveyed through sheet conveying paths 912-5 to 912-8, and is discharged onto a tray as a product.

The developing device e.g. for Y (yellow) used in the above-described color printer main unit 900 comprises a photosensitive drum 901*y*, and an electrostatic charge roller 902*y*, a laser unit 903*y*, and a development device 904*y*, which are arranged around the photosensitive drum 901*y*. When a toner image is developed by this developing device, first, a surface of the photosensitive drum 901*y* is charged by the electrostatic charge roller 902*y* to a predetermined potential and the potential is smoothed, while rotating the photosensitive drum 901*y* anticlockwise as shown in FIG. 2.

The laser unit 903*y* scans the surface of the charged photosensitive drum 901*y* with a laser beam to form a latent image. The photosensitive drum 901*y* having the latent image formed on the surface thereof has the latent image developed and visualized with toner by the development device 904*y*. The photosensitive drum 901*y* rotates to be brought into rotational contact with the intermediate transfer belt 906 as an intermediate transfer member, whereby the toner image developed on the surface of the photosensitive drum 901*y* is transferred onto the intermediate transfer belt 906.

Note that although the color printer as the image forming apparatus according to the present embodiment is provided with the four developing devices associated with the respective four colors of Y, M, C, and K, the developing devices associated with the respective three colors of M, C, and K are the same as the above-mentioned developing device associated with the color of Y, and hence description thereof is omitted.

The intermediate transfer belt 906 having the toner images of four colors transferred thereon by the four developing devices associated with the YMCK four colors moves to the secondary transfer rollers 907, and then transfers the resulting toner image onto the sheet 13 having been conveyed through the sheet conveying path 912-2. At this time, foreign matters, such as toner left untransferred and paper dust, remaining on the image bearing member, i.e. on the intermediate transfer belt 906 as the intermediate transfer member. In this color printer, to remove them, a cleaning blade 909 as a cleaning device is in contact with the intermediate transfer belt 906 as the intermediate transfer member.

In the color printer as the image forming apparatus according to the present embodiment, solid lubricant 100 is applied to reduce a frictional force between the cleaning blade 909 as the cleaning device and the intermediate transfer belt 906. Part of the solid lubricant 100 is scrubbed away by rotation of a lubricant application brush 101 as a fur brush, and adheres to the lubricant application brush 101. Then, when the lubricant application brush 101 as the rotating fur brush is brought into sliding contact with the intermediate transfer belt 906, the adhering solid lubricant 100 is applied to the surface of the intermediate transfer belt 906. Although in the present embodiment, zinc stearate is used as the solid lubricant 100, any other material may be used insofar as it can be used as lubricant, and can be used for the electrophotographic process. The details of the operation of the lubricant application brush will be described hereinafter.

Next, a detailed description will be given of respective mechanisms for performing cleaning and lubricant application.

The cleaning blade 909 as the cleaning device scrapes off foreign matters, such as toner left untransferred, on the surface of the intermediate transfer belt 906 by running of the intermediate transfer belt 906 with the cleaning blade 909 being in contact with the intermediate transfer belt 906.

Further, the cleaning blade 909 as the cleaning device is set such that an edge thereof is positively brought into contact with the surface of the intermediate transfer belt 906. However, the cleaning blade 909 is set such that a slight amount of toner having a small grain diameter enters between the edge of the cleaning blade 909 and the intermediate transfer belt 906 so as to reduce the frictional force.

Therefore, if the toner amount existing in the gap between the edge and the intermediate transfer belt 906 becomes very small because the amount of toner which has not been transferred, remaining after transfer of the toner image onto the sheet 13, has become very small, this increases the frictional force.

For example, when images which are very low in density are printed in succession, the amount of toner itself to be transferred is very small, which results in a very small amount of toner left untransferred. This causes the cleaning blade 909 and the intermediate transfer belt 906 to be brought into direct sliding contact with each other, whereby the frictional force increases.

When the two are in direct sliding contact as mentioned above, not only the edge and the surface of the intermediate transfer belt 906 are worn and are thereby quickly deteriorated, but also the edge is vibrated due to the increased frictional force, which generates storage noises.

Further, if the edge is vibrated, foreign matters pass between the edge and the intermediate transfer belt 906 when the gap therebetween opens wide, which makes it impossible to positively remove the remaining toner by the cleaning blade 909. As a consequence, foreign matters, such as toner and paper dust, are conveyed to the electrostatic charger, etc. in accordance with the operation of the intermediate transfer belt 906, which soils associated parts used in the process.

For example, in the case of the yellow image formation process, if the electrostatic charge roller 902*y* as the electrostatic charger is soiled, this causes a charging error, which makes it impossible to accurately form an electrostatic latent image on the photosensitive drum 901*y*. Further, in this case, since a toner image is developed based on the inaccurate electrostatic latent image, this results in an image failure of the product. Although the description has been given of the case of yellow by way of example, the same problem occurs in the respective cases of the colors of cyan, magenta, and black.

In the color printer as the image forming apparatus according to the present embodiment, to reduce the frictional force between the edge and the intermediate transfer belt 906, the solid lubricant 100 is applied onto the intermediate transfer belt 906 by the lubricant application brush 101. More specifically, when the lubricant application brush 101 as the fur brush is driven for rotation by an application brush drive motor 111, the lubricant application brush 101 is brought into sliding contact with a surface of the solid lubricant 100 by part of the rotational operation, to thereby cause the solid lubricant to adhere to the brush. Further, when the lubricant application brush 101 as the fur brush is brought into sliding contact with the intermediate transfer belt 906 by other part of the rotational operation, the lubricant application brush 101 applies the solid lubricant onto the surface of the intermediate transfer belt 906.

In the operation of applying the solid lubricant to the intermediate transfer belt 906 by the lubricant application brush 101, the amount of lubricant to be applied to the intermediate transfer belt 906 varies with the rotational speed of the lubricant application brush 101. In the color printer as the image forming apparatus according to the present embodiment, to adjust the amount of lubricant to be applied to the intermediate transfer belt 906, the rotational speed of the lubricant application brush 101 is controlled. The control of the application brush rotational speed will be described hereinafter.

The lubricant applied to the surface of the intermediate transfer belt 906 by the lubricant application brush 101 as mentioned above is conveyed to the cleaning device by running of the belt, and reaches the edge of the cleaning blade 909. Then, the lubricant enters a gap between the edge and the intermediate transfer belt 906, and reduces the frictional force.

At this time, if a more than necessary amount of lubricant is supplied, most of the excessive lubricant is removed by the cleaning blade 909. However, in this case, the amount of lubricant entering the gap between the edge and the intermediate transfer belt 906 increases, and part of the lubricant having entered the gap passes under the edge and reaches the electrostatic charger, and soils the electrostatic charger. Therefore, it is not preferable to apply an excessive amount of lubricant.

A proper amount of lubricant to be applied is only required to be an amount which prevents the cleaning blade 909 from generating abnormal noises and prevents the remaining toner from passing under the edge. Further, the proper amount of lubricant to be applied varies with the state of the frictional force between the cleaning blade 909 and the intermediate transfer belt 906. However, the state of the frictional force also varies with the amount of the remaining toner, as mentioned above, and hence it is difficult to predict and set the proper amount of the lubricant in advance.

Next, a detailed description will be given of a drive system for driving the intermediate transfer belt 906 and the lubricant application brush 101 in the present embodiment.

Figure 1:
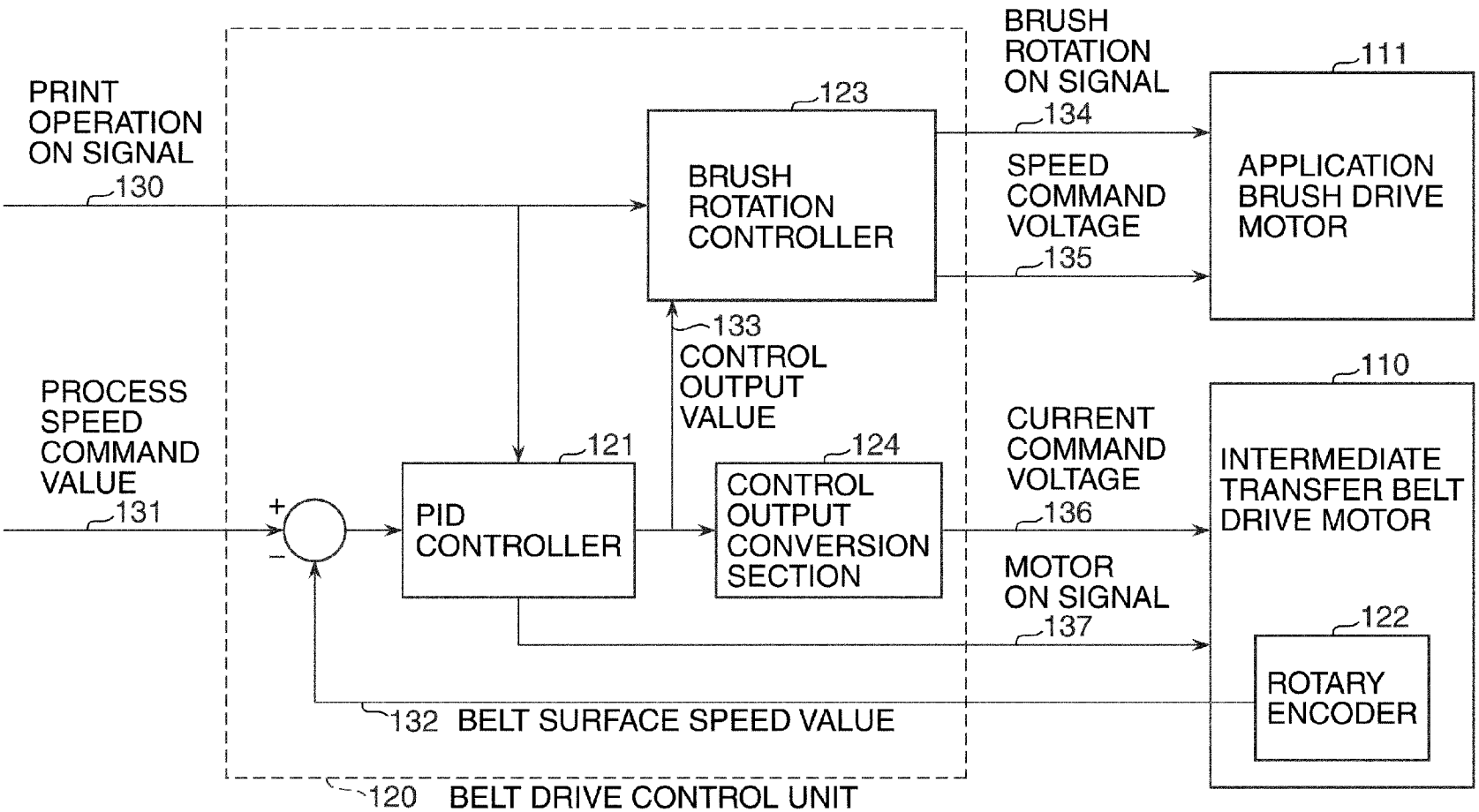
FIG. 1 is a block diagram of a control system including a belt drive control unit of an electrophotographic color printer as an image forming apparatus according to a first embodiment of the present invention.

FIG. 1 is a block diagram of a belt drive control unit 120 that controls the operation of the intermediate transfer belt 906 and the application brush drive motor 111, with a PID controller 121 as a first control unit and a brush rotation controller 123 as a second control unit being illustrated as respective separate blocks. However, the PID controller 121 and the brush rotation controller 123 may be implemented by a single CPU or a single ASIC (application specific integrated circuit), or the same functions as the PID controller 121 and the brush rotation controller 123 may be implemented on an engine controller, not shown. In these cases, it is also possible to obtain the same advantageous effects. Further, in the present embodiment, the description will be given assuming that the brush rotation controller 123 as the second control unit is formed by a single separate CPU.

The intermediate transfer belt 906 is driven by an intermediate transfer belt drive motor 110 as a first drive unit. The intermediate transfer belt drive motor 110 as the first drive unit has its speed controlled by the PID control unit as the first control unit so as to cause the intermediate transfer belt 906 to travel at a fixed process speed of e.g. 300 mm/s.

The intermediate transfer belt drive motor 110 starts to operate in response to a motor ON signal 137 directly output from the PID controller 121. Further, the intermediate transfer belt drive motor 110 incorporates a motor driver for receiving a current command voltage 136 and controlling a current for driving the intermediate transfer belt drive motor 110, and is configured to operate according to the current command voltage 136 input from the first control unit.

A rotary encoder 122 is disposed on an output shaft of the intermediate transfer belt drive motor 110 as the first drive unit. A traveling speed of the intermediate transfer belt 906 can be detected based on a rotational speed detected by the rotary encoder 122. Then, a belt surface speed value 132 indicative of the detected traveling speed of the intermediate transfer belt 906 is input to the belt drive control unit 120.

To the PID controller 121 of the belt drive control unit 120, a difference between a process speed command value 131 from the engine controller, not shown, and the belt surface speed value 132 indicative of the detected traveling speed of the intermediate transfer belt 906 is input, whereby the PID controller 121 controls the traveling speed of the intermediate transfer belt 906.

The PID controller 121 functioning as the first control unit performs general PID control in which respective gains for P control, I control, and D control are independently set. Further, the PID controller 121 includes an integrator associated with the I control and a differentiator associated with the D control.

The PID controller 121 as the first control unit outputs a value as a calculation result of the PID control to a control output conversion section 124. The control output conversion section 124 converts the calculation result output from the PID controller 121 to the current command voltage 136 to be output to the intermediate transfer belt drive motor 110 as the first drive unit.

Next, a description will be given of a waveform of a main signal and the operation timing in the block diagram shown in FIG. 1.

Note that in the color printer as the image forming apparatus according to the present embodiment, it is assumed that the application of the lubricant is continuously performed during rotation of the intermediate transfer belt 906. However, in executing lubricant application amount control by a method described hereinafter, the present invention can be applied even in a case where the application of the lubricant is intentionally stopped e.g. by a method of moving the lubricant application brush 101 away from the intermediate transfer belt 906, and the lubricant application brush 101 is caused to be intermittently operated.

In the belt drive control unit 120 according to the present embodiment, all operations are started upon receipt of a print operation ON signal 130 output from the engine controller, not shown. The intermediate transfer belt drive motor 110 and the application brush drive motor 111, as a second drive unit are configured to operate in synchronism with the print operation ON signal 130, and the process speed command value 131 is also synchronized with the print operation ON signal 130.

Figure 3A:
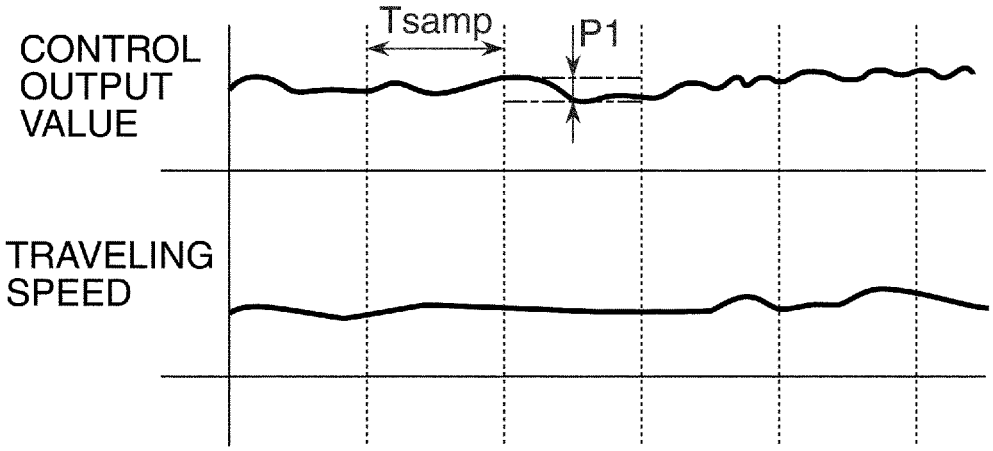
FIG. 3A is a graph showing a relationship between the traveling speed of an intermediate transfer belt and a control output value, exhibited when the electrophotographic color printer shown in FIG. 2 is in a normal operation state.

Next, a description will be given of a relationship between the traveling speed of the intermediate transfer belt 906 and the control output value with reference to FIGS. 3A and 3B.

The intermediate transfer belt 906 is controlled to travel at a process speed during the print operation. At this time, the relationship between the traveling speed and the control output value exhibited when a proper amount of the lubricant is applied is expressed by a graph shown in FIG. 3A.

A speed waveform exhibited when the intermediate transfer belt 906 is controlled during the print operation does not go beyond a minute range of speed variation from the process speed. Further, the control output value varies with the speed variation in order to hold constant the traveling speed of the intermediate transfer belt 906.

At this time, the intermediate transfer belt 906 is brought into contact with the cleaning blade 909 and the photosensitive drum 901*y*. As a consequence, the speed waveform exhibited when the control during the print operation is executed has a torque disturbance reflected thereon. The belt drive control unit 120 performs the speed control by changing the control output value such that the torque disturbance is cancelled out to thereby prevent the traveling speed variation of the intermediate transfer belt 906 from going beyond a predetermined range within which no image failure is caused.

This torque disturbance is mainly caused by the traveling speed variation of the photosensitive drum 901 or the friction with the cleaning blade 909. When the torque disturbance becomes large, it is possible to reduce the traveling speed variation by increasing the degree of change in the control output value as a result of motor control. Further, the traveling speed variation of the photosensitive drum 901 is also caused when the torque fluctuation occurring when the electrostatic charger and the development device 904 operate is transmitted to the intermediate transfer belt 906.

Figure 3B:
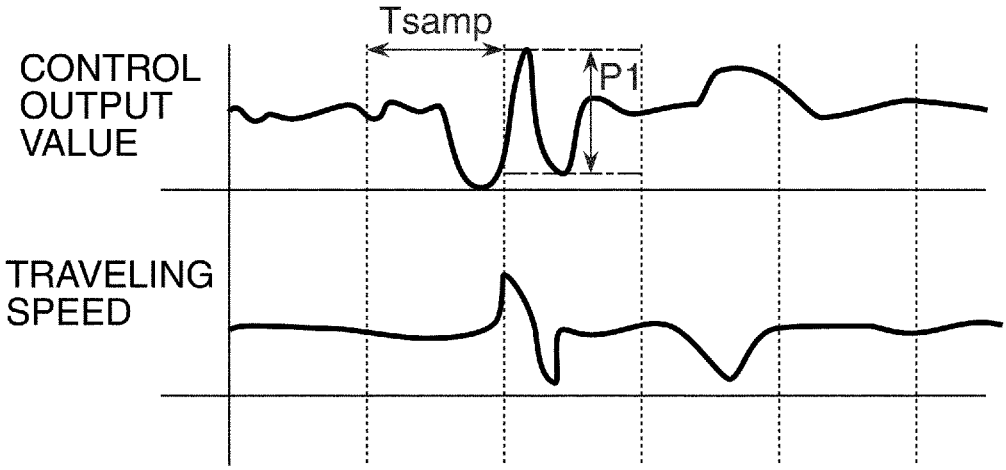
FIG. 3B is a graph showing a relationship between the traveling speed of the intermediate transfer belt and the control output value, exhibited indicated when the electrophotographic color printer shown in FIG. 2 is in an insufficient lubricant state.

However, as shown in FIG. 3B, when the friction increases due to insufficiency of the lubricant, the control output value goes beyond a range of assumable values, which makes it impossible to hold the fluctuation in traveling speed of the intermediate transfer belt 906 within an allowable range.

Further, even when the traveling speed is controlled to within the acceptable range to successfully perform the traveling speed control, if the frictional force between the intermediate transfer belt 906 and the cleaning blade 909 increases, noises are generated from the blade edge and the fluctuation range of the current command value as a result of the fluctuation in frictional force increase.

As described above, it is understood that to detect an increase in the frictional force of the cleaning blade 909 as a cause of the torque disturbance, it is only required to detect an increase in a fluctuation range P1 of the control output value.

Figure 4A:
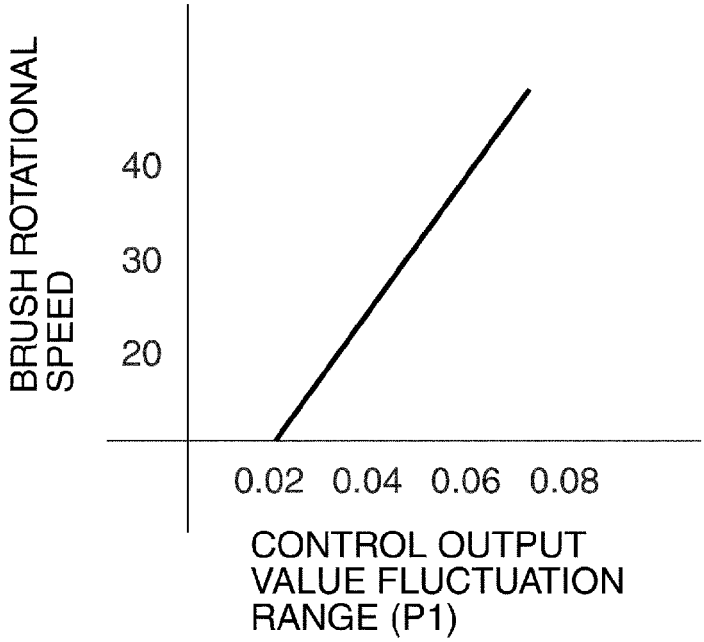
FIGS. 4A and 4B are views useful in explaining a fluctuation range of the control output value used in belt drive control performed by the electrophotographic color printer.
Figure 4B:
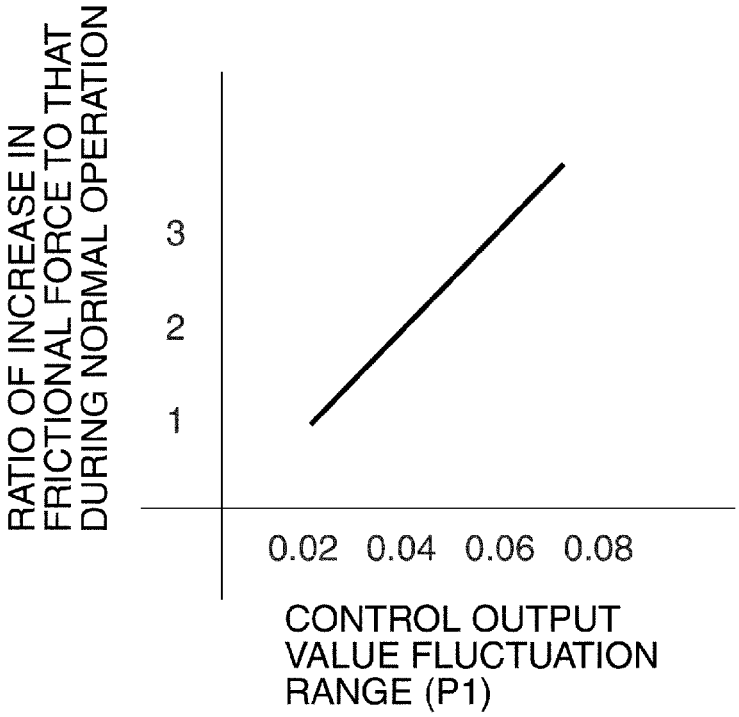

Here, a magnitude of the control output value fluctuation range P1 and a ratio of increase in the frictional force to that during normal operation of the intermediate transfer belt 906 have a relationship as shown in FIG. 4B. Therefore, it is possible to estimate the magnitude of the frictional force of the cleaning blade 909 from the fluctuation range of the current command value of the motor to thereby control the amount of lubricant to be applied according to the magnitude of the frictional force.

To control the amount of lubricant to be applied according to the magnitude of the frictional force, the brush rotation controller 123 calculates a maximum value and a minimum value of a control output value 133 output from the PID controller 121 during a predetermined period Tsamp, described hereinafter. Then, the brush rotation controller 123 as the second control unit calculates a difference between the maximum value and the minimum value of the control output value 133 to thereby detect the fluctuation range P1 of the control output value. That is, the brush rotation controller 123 detects the fluctuation range P1 of the control output value at a predetermined sampling period.

The belt drive control unit 120 controls to increase the amount of lubricant to be applied so as to reduce the frictional force, when the control output value fluctuation range P1 is large, and reduce the same so as to prevent the lubricant from being excessively applied, when the control output value fluctuation range P1 is small.

Figure 5:
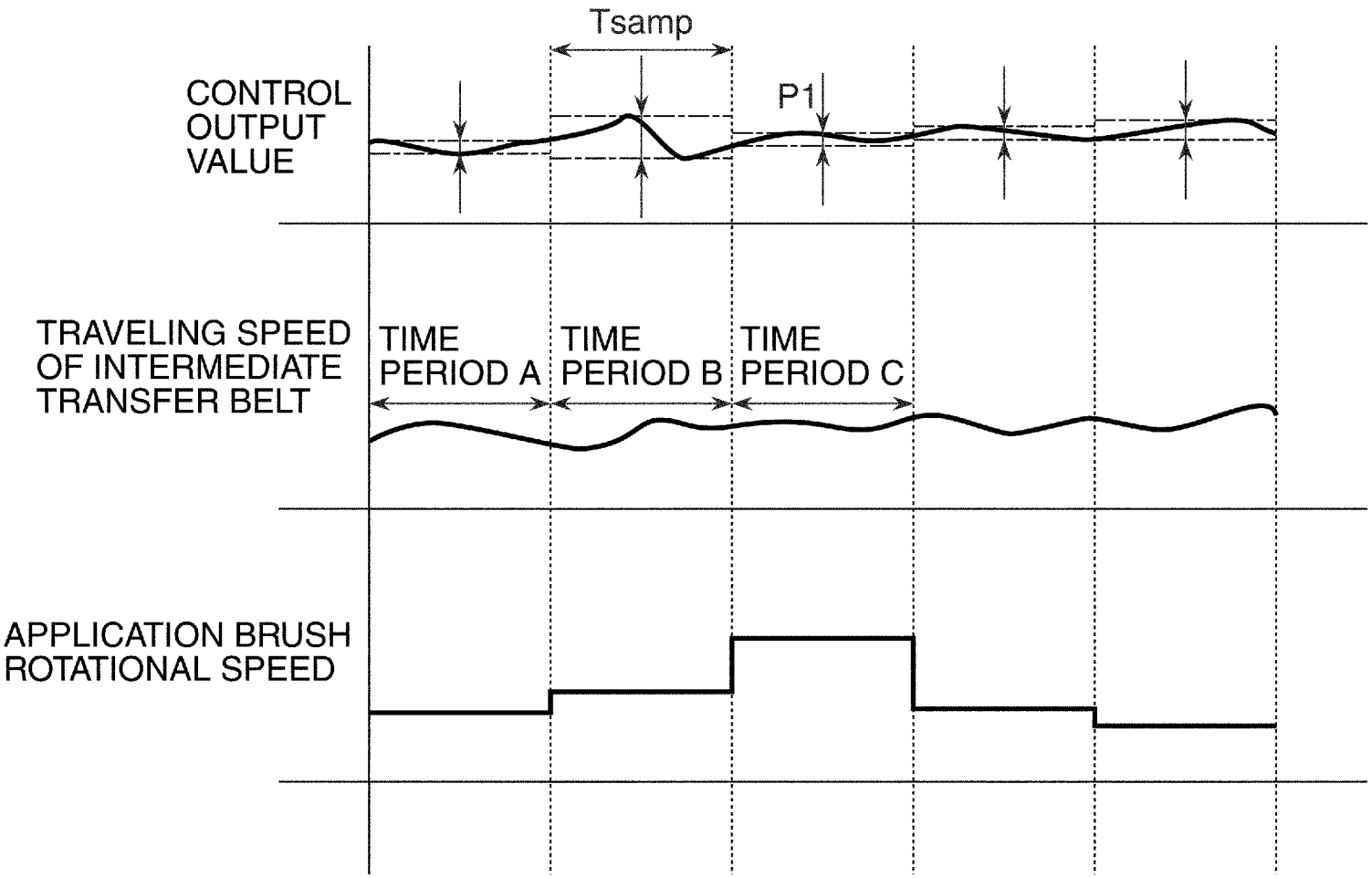
FIG. 5 is a timing diagram useful in explaining changes in the fluctuation range of the control output value and timing in which the rotational speed of an application brush is changed during the belt drive control performed by the electrophotographic color printer.

For example, as shown in FIG. 5, the brush rotation controller 123 as the second control unit determines a target value of the rotational speed of the lubricant application brush 101 (application brush rotational speed) based on the control output value range P1 calculated in a time period A, and controls the application brush drive motor 111 such that the application brush rotational speed becomes equal to the calculated target value, in a time period B. Similarly, the brush rotation controller 123 controls the application brush drive motor 111 such that the application brush rotational speed becomes equal to a target value calculated using the control output value range P1 calculated in the time period B in the time period B.

To determine the amount of lubricant to be applied as mentioned above, the brush rotation controller 123 has data shown in FIG. 4A, which was prepared in advance based on the relationship between the magnitude of the control output value fluctuation range P1 and the ratio of increase in the frictional force, shown in FIG. 4B, and corresponds to a table, not shown, which is looked up in a step S706 of a brush rotation control process, described hereinafter. The brush rotation controller 123 determines the rotational speed of the lubricant application brush 101 according to the control output value fluctuation range P1, which is calculated as described hereinafter. Although the data (table values) can be obtained based on measurement using an actual equipment, the data varies with the materials, shapes, surface properties, etc. of the cleaning blade 909 and the intermediate transfer belt 906, and hence the data is unique to each of machines (color printers) having the same design.

Further, the data shown in FIG. 4A is configured such that the application brush rotational speed becomes equal to 0 rpm when the control output value fluctuation range P1 is not higher than 0.02.

By configuring the data as described above, in a state in which the fluctuation range P1 of the control output value 133 is sufficiently small and hence the frictional force is held at a low level, it is possible to stop application of the lubricant by stopping the rotation of the lubricant application brush 101. When the lubricant is prevented from being excessively applied as mentioned above, it is possible to prevent the solid lubricant 100 from being excessively consumed, and also prevent the electrostatic charger from being soiled.

Next, a description will be given of the brush rotation control process executed by the brush rotation controller 123 of the color printer as the image forming apparatus according to the present embodiment with reference to FIG. 6.

The print control ON signal 130 and the process speed command value 131 are input from the engine controller, not shown, to the belt drive control unit 120.

When the print operation is started, the print control ON signal 130 and the process speed command value 131 are input from the engine controller to the belt drive control unit 120. At this time, the two signals are input in synchronism with each other.

Figure 6:
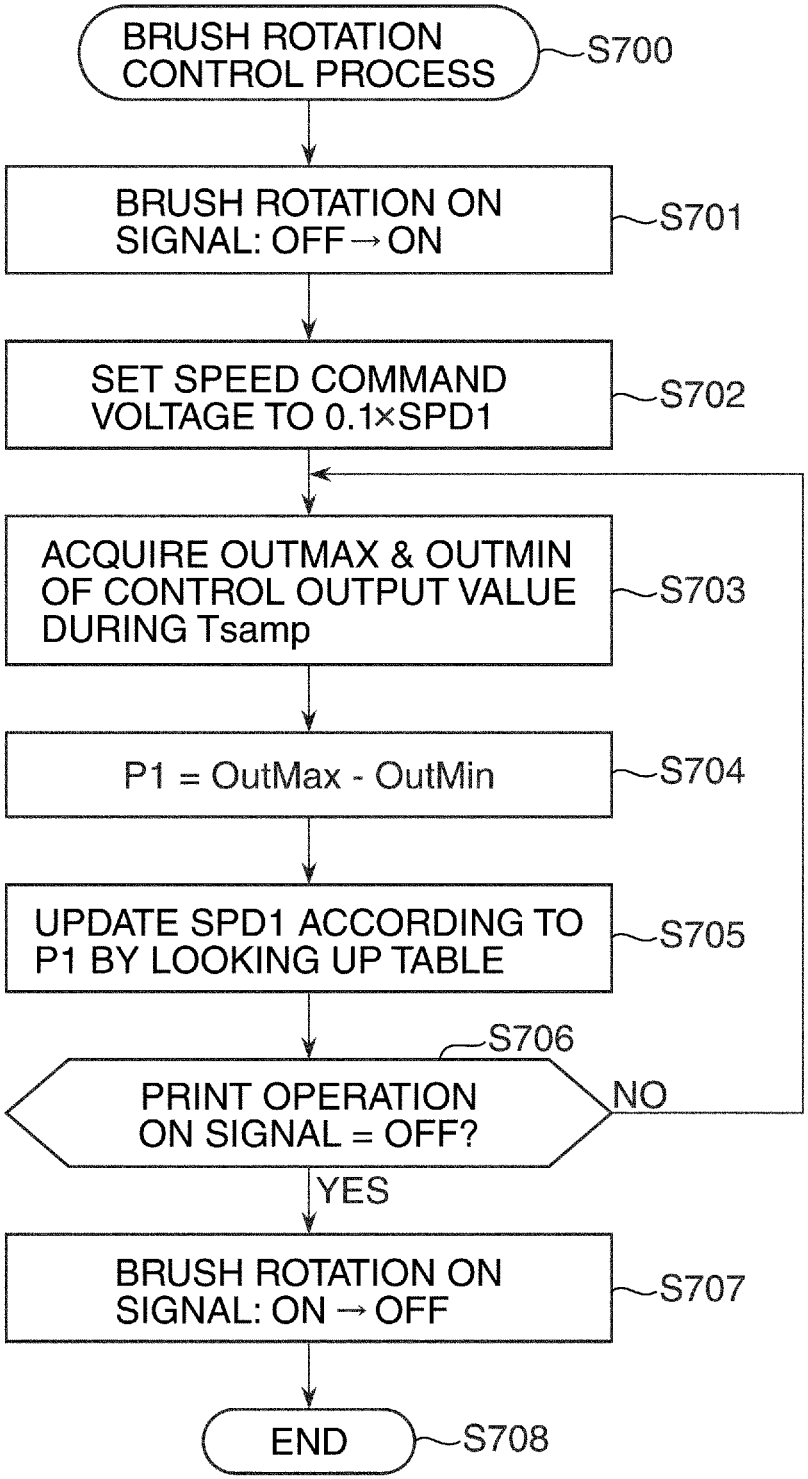
FIG. 6 is a flowchart of a brush rotation control process executed by the electrophotographic color printer.

In the color printer as the image forming apparatus according to the present embodiment, when the print operation ON signal turns on, the brush rotation control process shown in FIG. 6 is started. The belt drive control unit 120 is configured such that at this time, the print operation ON signal is input not only to the brush rotation controller 123 but also to the PID controller 121, whereby during operation of the brush rotation controller 123, the PID controller 121 also operates.

After the operation of the brush rotation control process has been started, the brush rotation controller 123 turns on the brush rotation ON signal 134 to cause rotation of the application brush drive motor 111 (step S701).

Next, the brush rotation controller 123 sets a speed command voltage 135 to a voltage obtained by multiplying a variable SPD1 representative of the speed command voltage 135 by a coefficient 0.1 (step S702). Note that an initial value of the variable SPD1 immediately after the operation has been started is equal to 0. In the present embodiment, the range of voltage input as the speed command voltage 135 is set to 0 to 5V. Therefore, by setting the relationship of the speed command voltage (V)=SPD1×0.1, it is possible to express a speed region of the application brush drive motor 111 up to approximately 50 rpm, by an applied voltage of 0 to 5V. The rotational speed of the application brush drive motor 111 becomes equal to a speed corresponding to the speed command voltage 135 when the brush rotation ON signal 134 is on.

Next, the brush rotation controller 123 continues sampling the control output values over the predetermined period Tsamp [10 seconds in the present embodiment], and stores the maximum value, denoted by OutMax, and the minimum value, denoted by OutMin, during the sampling period (step S703). Here, the predetermined period Tsamp (predetermined sampling period) is required to be set to a time period long enough to measure a control output fluctuation range (fluctuation range of the control). Note that although different depending on characteristics of a machine (color printer), the predetermined period Tsamp (predetermined sampling period) is set to a time period over which the intermediate transfer belt 906 approximately makes one rotation. When the predetermined period Tsamp (predetermined sampling period) is set as mentioned above, it is possible to obtain the control output fluctuation range on which the frictional condition on the surface of the intermediate transfer belt 906 is reflected.

Next, the brush rotation controller 123 calculates the control output value fluctuation range P1 during the predetermined period Tsamp (predetermined sampling period) by subtracting the minimum value OutMin from the maximum value OutMax (step S704). Next, the brush rotation controller 123 updates the value of the variable SPD1 by looking up the table corresponding to the graph shown in FIG. 4A, not shown, according to the calculated value of the control output value fluctuation range P1 (step S705). For example, when the value of the control output value fluctuation range P1 is equal to 0.3, the value of the variable SPD1 becomes equal to 10.

Next, after the variable SPD1 has been updated, the brush rotation controller 123 determines whether or not the print operation ON signal is off (step S706). If it is determined that the print operation ON signal is on (NO to the step S706), this indicates that the print operation is being continued, and hence the brush rotation controller 123 returns to the step S703 to shift to the operation for detecting the maximum value OutMax and the minimum value OutMin again. On the other hand, if it is determined that the print operation ON signal is off (YES to the step S706), the brush rotation controller 123 turns off the brush rotation ON signal 134 to stop the application brush drive motor 111 (step S707) and stops the operation of the brush rotation controller 123, followed by terminating the present brush rotation control process.

Note that the lubricant application amount control described in the present embodiment is applied to the intermediate transfer belt 906 as the image bearing member. However, it is to be understood that the lubricant application amount control according to the present embodiment can also be applied to a case where the lubricant is supplied to the photosensitive drum 901 or a photosensitive member belt as an image bearing member.

Figure 7:
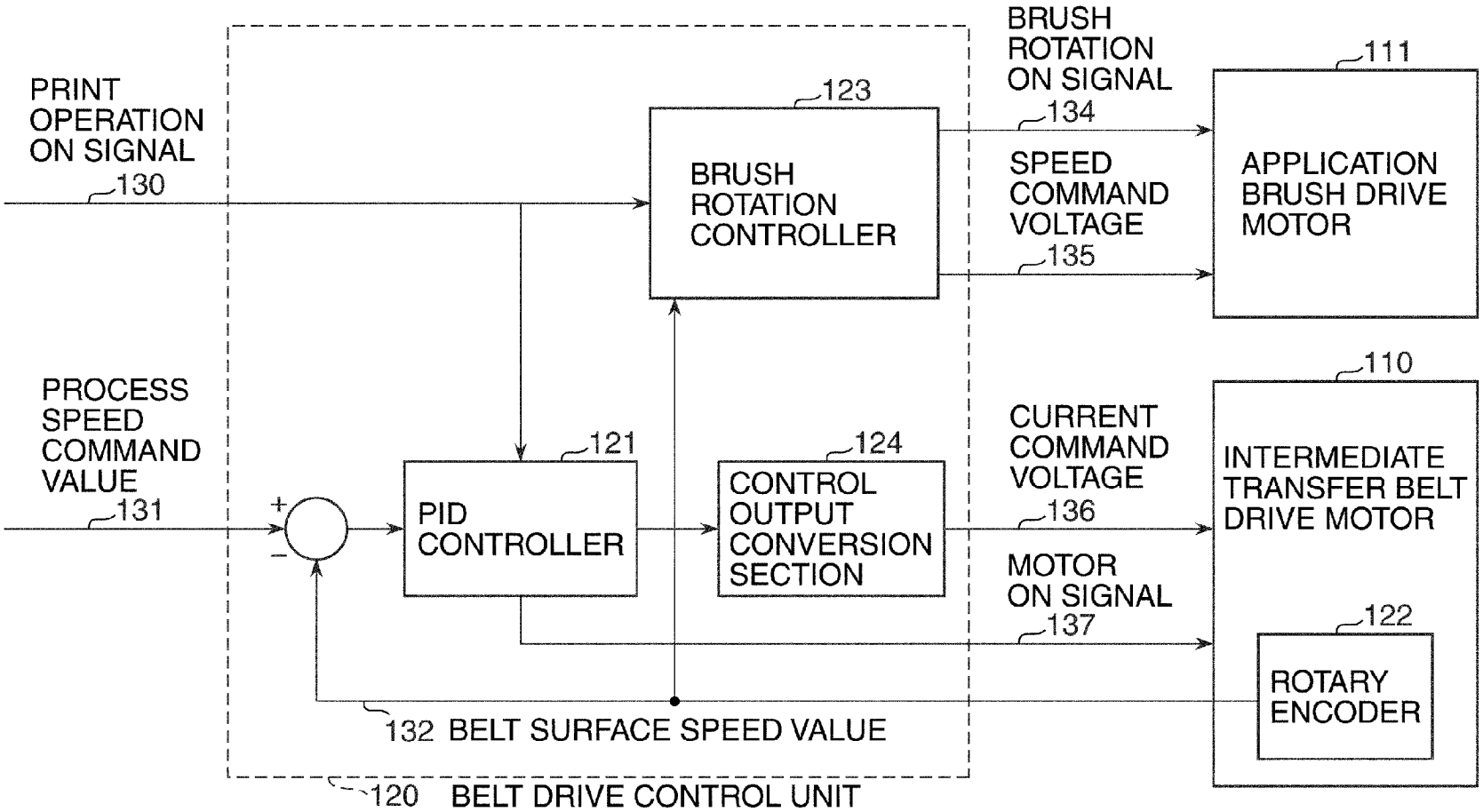
FIG. 7 is a block diagram of a control system including a belt drive control unit of an electrophotographic color printer as an image forming apparatus according to a second embodiment of the present invention.
Figure 8A:
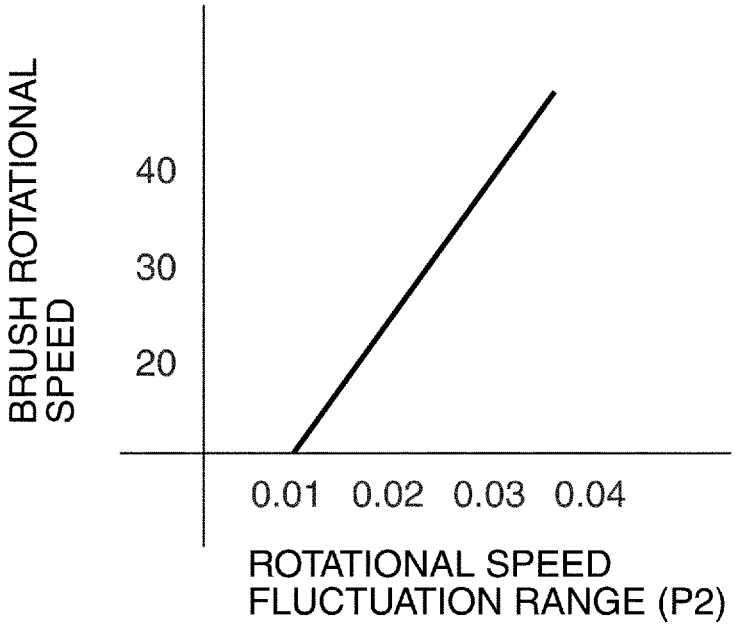
FIGS. 8A and 8B are views useful in explaining a fluctuation range of a rotational speed used in belt drive control performed by the electrophotographic color printer as the image forming apparatus according to the second embodiment.
Figure 8B:
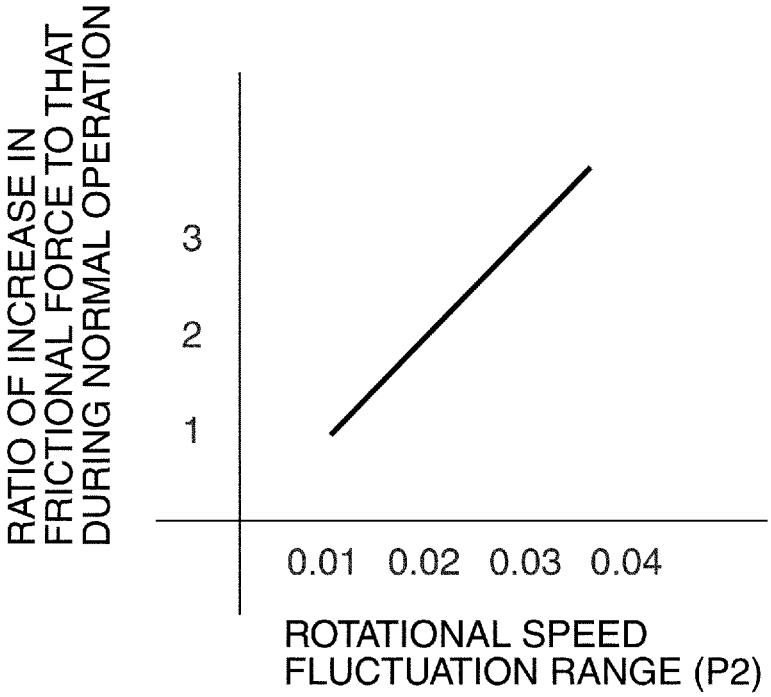

Hereinafter, a description will be given of a second embodiment of the present invention with reference to FIGS. 7, 8A, and 8B. In the description of the second embodiment, detailed description of the same components as those in the above-described first embodiment is omitted.

The second embodiment is changed from the above-described first embodiment in the configuration that the target value of the rotational speed of the lubricant application brush 101 is determined according to the control output value fluctuation range P1. More specifically, in the second embodiment, a rotational speed fluctuation range P2 of the image bearing member detected by the encoder 122 is used in place of the control output value fluctuation range P1. For example, in a case where the PID controller 121 and the brush rotation controller 123 are implemented as respective separate ICs, the configuration that monitors the belt surface speed value 132 is sometimes more advantageous than the configuration that monitors the control output value 133 in terms of arrangement and costs.

Further, a method of calculating the rotational speed fluctuation range P2 is the same as the above-described method of calculating the rotational speed fluctuation range P1 in the first embodiment, and hence description thereof is omitted, but the second embodiment differs from the first embodiment in that the belt surface speed value 132 is input to the brush rotation controller 123 in place of the control output value 133.

It is known that as the rotational speed fluctuation range P2 detected by the encoder is larger, the control output value fluctuation range P1 described in the first embodiment is larger. This is understood from the fact that the rotational speed control is performed by feedback control as shown in FIG. 1. This feedback control is performed such that a change in the control output based on a very small change in the monitored value causes the monitored value to be accommodated within a predetermined fluctuation range. In such feedback control, a very small change in the monitored value exists even in a state in which the control is successfully performed. Further, when the control output value fluctuation range P1 increases, the above-mentioned small rotational speed fluctuation range P2 also increases.

As described above, the same behavior as in the control output value fluctuation described in the first embodiment also appears in the result of monitoring of the rotational speed. Then, the rotational speed fluctuation range P2 is calculated by subtracting the minimum value OutMin from the maximum value OutMax in the rotational speed of the image bearing member detected by the encoder 122 during the predetermined period Tsamp, based on the result of monitoring of the rotational speed fluctuation. Then, a target value of the application brush rotational speed is determined by looking up, according to the thus calculated rotational speed fluctuation range P2, a table (corresponding to a graph shown in FIG. 8A) which was prepared based on the relationship between the ratio of increase in the frictional force and the magnitude of the rotational speed fluctuation range P2, shown in FIG. 8B, which was empirically determined e.g. by experiment, whereby the brush rotation control process similar to that in the above-described first embodiment is performed.

Next, a description will be given of a third embodiment of the present invention with reference to FIGS. 9, 10A, and 10B. In the description of the third embodiment, detailed description of the same components as those in the above-described first embodiment is omitted. Note that changes in a motor drive current value 138 supplied to the intermediate transfer belt drive motor 110 and a timing in which the rotational speed of an application brush is changed during belt drive control performed by an electrophotographic color printer as an image forming apparatus according to a third embodiment of the invention are substantially the same as shown in the timing diagram in FIG. 5, provided that the control output value and the control output value fluctuation range P1 are replaced by the motor drive current value and a motor drive current fluctuation range P3, respectively.

First, a method of determining the application brush rotational speed in the color printer as the image forming apparatus according to the third embodiment will be described. In the color printer as the image forming apparatus according to the third embodiment, the motor drive current fluctuation range P3 shown in FIGS. 10A and 10B has a correlation with the control output value fluctuation range P1 in the above-described first embodiment.

Similarly to the first embodiment described with reference to FIG. 5, in the color printer as the image forming apparatus according to the third embodiment, when the motor drive current fluctuation range P3 is large, the frictional force is larger than that during the normal operation. Therefore, when the motor drive current fluctuation range P3 is large, it is necessary to increase the amount of lubricant to be applied by increasing the application brush rotational speed to thereby reduce the frictional force. As mentioned above, the motor drive current fluctuation range P3 has characteristics similar to those of the control output value fluctuation range P1. Therefore, the third embodiment is configured by making use of these characteristics such that a target value of the application brush rotational speed is determined based on the motor drive current fluctuation range P3.

In other words, the third embodiment is changed from the above-described first embodiment in the configuration that the target value of the rotational speed of the lubricant application brush 101 is determined according to the control output value fluctuation range P1. More specifically, the third embodiment is configured such that the target value of the rotational speed of the lubricant application brush 101 is determined from the motor drive current fluctuation range P3 of the intermediate transfer belt drive motor 110.

The process in which the brush rotation controller 123 determines the motor drive current fluctuation range P3 in the third embodiment is the same as the process described with reference to FIG. 5 in the first embodiment in which the brush rotation controller 123 determines the control output value fluctuation range P1 except that an input to the brush rotation controller 123 is changed from the control output value 133 to the motor drive current value 138. More specifically, in the third embodiment, the brush rotation controller 123 calculates the difference between the maximum value and the minimum value of the motor drive current value 138 during the predetermined period Tsamp, to thereby determine the motor drive current fluctuation range P3.

Figure 9:
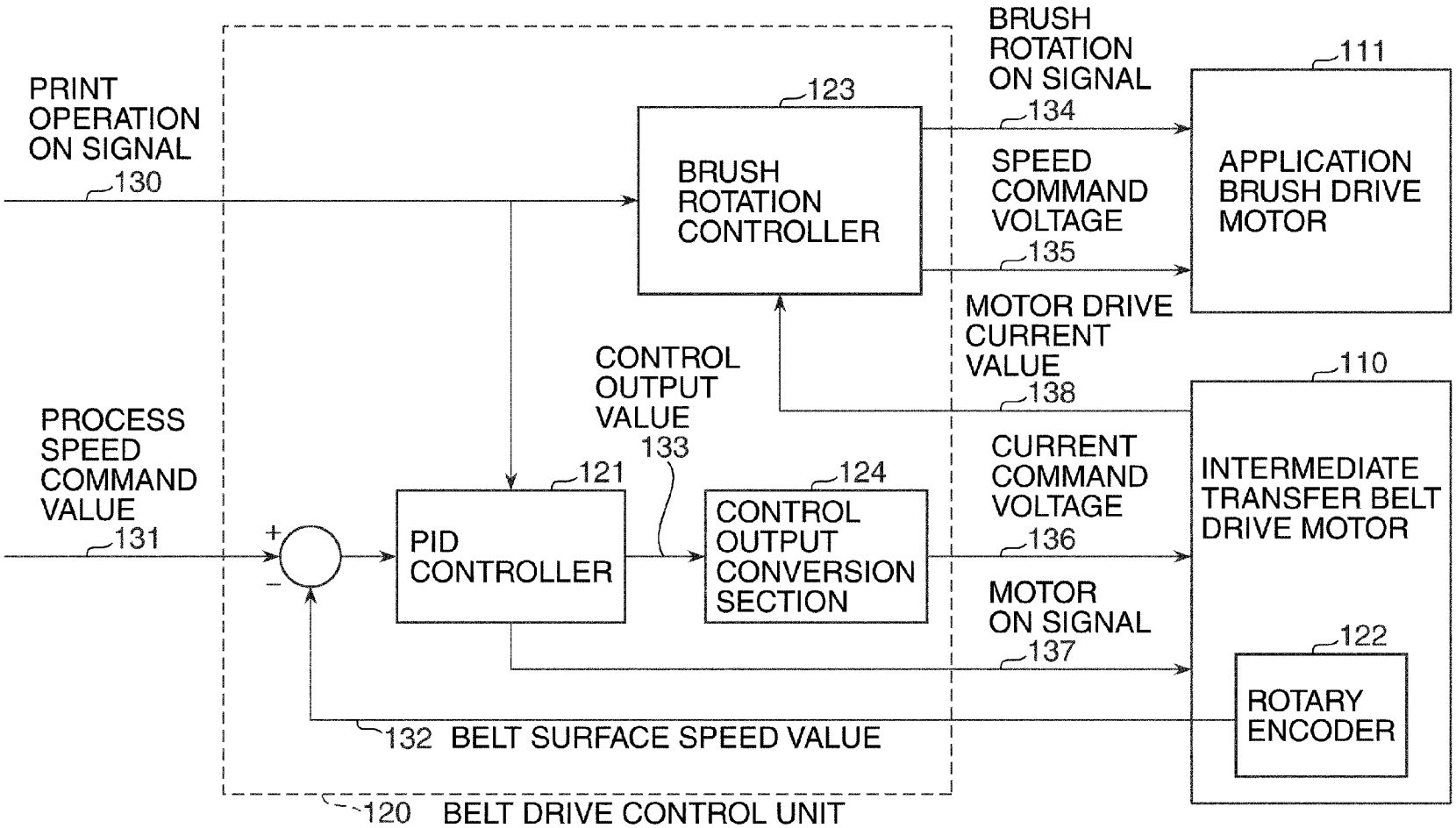
FIG. 9 is a block diagram of a control system including a belt drive control unit of an electrophotographic color printer as an image forming apparatus according to a third embodiment of the present invention.
Figure 10A:
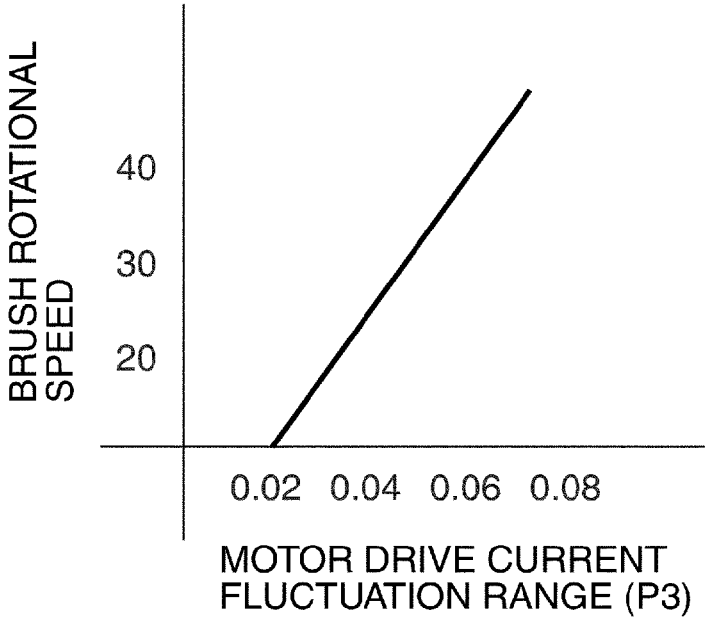
FIGS. 10A and 10B are explanatory views of a fluctuation range of a motor drive current used in belt drive control performed by the electrophotographic color printer as the image forming apparatus according to the third embodiment.

In the color printer according to the third embodiment shown in FIG. 9, the PID controller 121 that functions as the first control unit outputs the control output value 133. Then, the control output value 133 is converted to the current command voltage 136 by the control output conversion section 124, and the current command voltage 136 is transmitted to the intermediate transfer belt drive motor 110. The intermediate transfer belt drive motor 110 controlled by the transmitted current command voltage 136 delivers a motor drive current value 138 indicative of a value of a motor drive current caused to flow therethrough 110 by the current command voltage 136, to the brush rotation controller 123.

Therefore, input to the belt drive control unit 120, is the motor drive current value 138 having a fluctuation in the control output value 133 directly reflected thereon. Therefore, in the third embodiment, the motor drive current fluctuation range P3 is calculated by subtracting the minimum value OutMin of the motor drive current value 138 from the maximum value OutMax of the same, during the predetermined time period Tsamp. In the third embodiment, the thus calculated motor drive current fluctuation range P3 is used in place of the control output value fluctuation range P1.

Figure 10B:
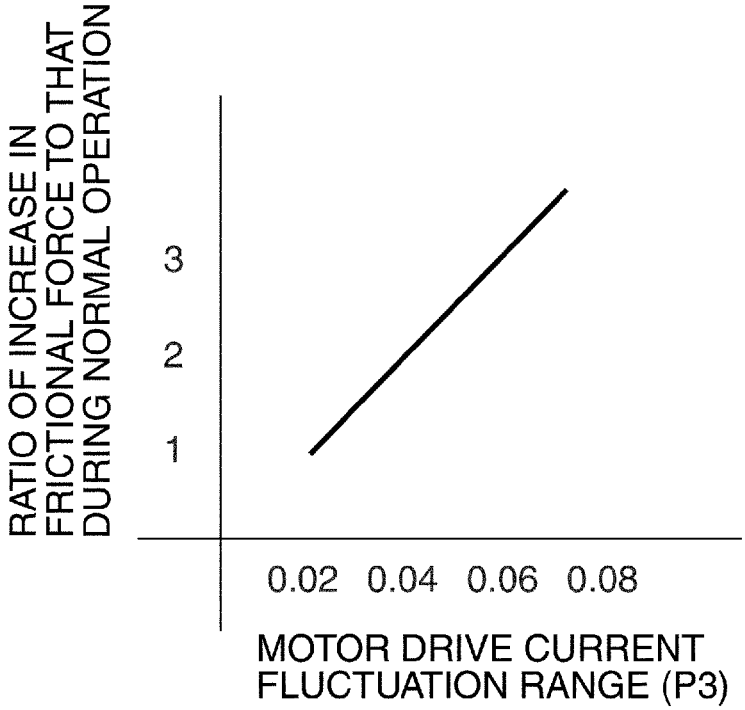

Then, a target value of the rotational speed of the application brush drive motor 111 as the second drive unit is determined by looking up, according to the thus calculated motor drive current fluctuation range P3, a table (corresponding to a graph shown in FIG. 10A) which was prepared based on the relationship between the ratio of increase in the frictional force and the magnitude of the motor drive current fluctuation range P3, shown in FIG. 10B, which was empirically determined e.g. by experiment, whereby the brush rotation control is performed similarly to that in the above-described first embodiment.

Although in the above-described embodiments, the description has been given of the case where the invention is applied to the intermediate transfer belt 906 as the image bearing member, it is to be understood that the invention can also be applied to a case where the image bearing member is a photosensitive drum (e.g. the photosensitive drum 901 in the above-described embodiments).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-154795, filed Jul. 13, 2011, which is hereby incorporated by reference herein in its entirety.

What is claimed is:

1. An image forming apparatus comprising:

an image bearing member configured to bear a toner image;

a drive unit configured to drive said image bearing member;

a first control unit configured to control said drive unit to drive said image bearing member at a constant speed;

a cleaning unit configured to clean a surface of said image bearing member;

a lubricant application unit configured to apply a lubricant to the surface of said image bearing member; and a second control unit configured to control an amount of the lubricant to be applied to said image bearing member by said lubricant application unit, wherein said second control unit is configured:

to sample a signal varied in accordance with a friction between said cleaning unit and said image bearing member; and to set the controlled amount of the lubricant in accordance with a difference between a maximum value and a minimum value of the signal sampled in a predetermined time period.

2. The image forming apparatus according to claim 1, wherein said lubricant application unit has a motor and an application member rotated by the motor to apply the lubricant, and said second control unit is configured to control a rotational speed of the application member to control the amount of the lubricant.

3. The image forming apparatus according to claim 1, wherein said first control unit is configured to output a control signal for controlling said drive unit, said second control unit is configured to sample the control signal as the signal varied in accordance with the friction.

4. The image forming apparatus according to claim 1, further comprising a generating unit configured to generate a signal according to a driving speed of said image bearing member, said second control unit is configured to sample the signal generated by said generating unit as the signal varied in accordance with the friction.

5. The image forming apparatus according to claim 1, wherein said first control unit is configured to generate signals indicating a drive current for driving said image bearing member, said second control unit is configured to sample the signal indicating the drive current as the signal varied in accordance with the friction.

6. The image forming apparatus according to claim 1, wherein said image bearing member is a photosensitive drum.

7. The image forming apparatus according to claim 1, wherein said image bearing member is an intermediate transfer member.

8. The image forming apparatus according to claim 1, wherein said second control unit is configured to calculate, at the predetermined time period intervals, the difference between the maximum value and the minimum value of the signals changed in accordance with a friction.

9. The image forming apparatus according to claim 8, wherein said second control unit is configured to determine the amount of lubricant to be applied in a next predetermined time period based on the difference calculated in the predetermined time period.

10. The image forming apparatus according to claim 8, wherein said second control unit is configured to set the amount of the lubricant to a first amount, when a first value is calculated as the difference, while setting the amount of the lubricant to a second amount when the a second value is calculated as the difference.

* * * * *